United States Patent [19]

Blumle et al.

[11] Patent Number: 4,936,816

[45] Date of Patent: Jun. 26, 1990

[54] PROCESS AND APPARATUS FOR OPENING THE SEALING FLAPS OF A CARTON

[75] Inventors: Martin Blumle, Hornhausen; Antonius Kloft, Hahn am See, both of Fed. Rep. of Germany

[73] Assignee: Winkler & Dunnebier Maschinenfabrik und Eisengiesserei KG, Neuwied, Fed. Rep. of Germany

[21] Appl. No.: 333,183

[22] Filed: Apr. 4, 1989

[30] Foreign Application Priority Data

Apr. 16, 1988 [DE] Fed. Rep. of Germany ..... 3812749

[51] Int. Cl.[5] ..... B31F 1/10; B65B 1/04; B65B 43/39

[52] U.S. Cl. ..... 493/183; 493/309; 493/319; 493/441; 493/442; 53/243; 53/382; 53/458; 53/473; 414/411

[58] Field of Search ..... 53/242, 243, 250, 381 R, 53/382, 452, 458, 473, 492, 564, 558; 414/411; 493/309, 319, 419, 183, 318, 441, 442

[56] References Cited

U.S. PATENT DOCUMENTS

| | | | |
|---|---|---|---|
| 2,761,263 | 9/1956 | Bruce | 414/411 X |
| 2,815,140 | 12/1957 | Dice | 414/411 |
| 2,855,117 | 10/1958 | Neal et al. | 414/411 |
| 3,451,195 | 6/1969 | Roth et al. | 53/382 |
| 3,521,427 | 7/1970 | Masch | 53/564 X |
| 3,846,962 | 11/1974 | Rossi | 53/382 X |
| 3,863,427 | 2/1975 | Rossi | 53/382 |
| 4,567,712 | 2/1986 | Varallo et al. | 53/250 X |

*Primary Examiner*—Robert L. Spruill
*Assistant Examiner*—Beth Bianca
*Attorney, Agent, or Firm*—Collard, Roe & Galgano

[57] ABSTRACT

A process and apparatus for opening the sealing flaps of a carton using drive elements for spreading or folding such sealing flaps open as required for packaging cartons having sealed bottoms. The boxes are inverted and lowered from a floating position with the bottom up and the sealing flaps hanging down. The flaps are placed on drive elements which move away from each other and in the flap opening direction. The box is then moved to a packaging area in the inverted position and lowered over the materials to be packaged.

11 Claims, 6 Drawing Sheets

PROCESS AND APPARATUS FOR OPENING THE SEALING FLAPS OF A CARTON

BACKGROUND OF THE INVENTION

This invention relates to a process and an apparatus for opening the sealing or top flaps of a carton or cardboard box. More particularly, the invention relates to a process for spreading or for folding open the sealing flaps of cartons already sealed on the bottom side in order to allow packaging thereof.

Paperboard cartons having open top flaps and previously sealed bottom flaps are often used for packaging. If, for example, on a letter envelope packaging machine, the cardboard boxes or cartons are pushed over a stack of letter envelopes from above, it is necessary that the still-open sealing flaps, which are at the bottom during this packaging step, are in a position which does not interfere with the packaging operation. In particular, the flaps must not get in the way of the material being packaged. Consequently their adjacent free edges should be folded as far away from the box as possible, i.e., the edges should be pointing outwardly. To accomplish this result the prior art apparatuses use, for example, suction elements or swinging arms, by means of which the flaps are brought into the desired open position. The problem with the prior art equipment is that these known devices depend on the carton dimensions, i.e., they have to set up for whichever box sizes are being processed, and they have to be changed when the dimensions change. This requires a longer machine shutdown time to modify the machine to accept different boxes. Moreover, controlling and storing the suction elements and swinging arms is complicated and expensive and, therefore, susceptible to breakdown.

SUMMARY OF THE INVENTION

It is an object of the invention to provide a process and an apparatus for spreading open the sealing flaps of cartons where the bottom flaps are already closed.

It is yet another object of the invention to provide a process and apparatus which is simple and uncomplicated in design and can be easily adapted to different carton sizes.

Accordingly, these and related objects are achieved by the process of the invention wherein the cartons with their bottom sides closed, are lowered from an inverted floating position with the bottom up and the flaps hanging down, and placed on drive elements moving away from each other. As the boxes are lowered, the edges of the sealing flaps—which may be in any position—come into contact with the drive elements, which are moving in the opening direction. After contacting the drive elements the flaps are spread apart into the desired open position. The drive elements may be endless rotating belts, linearly moving slide members, or rolls (rollers). It is important only that the drive elements moves in a direction which spreads the flaps open. For example, when using endless revolving belts, at least two of such belts are employed whose upper runs serve as the drive elements and which rotate in opposite directions (i.e., away from each other). This direction corresponds with the desired direction for opening the flaps. For opening four flaps, preferably four belts, rolls or linearly movable slide members serve as drive elements. The opening and unfolding operation is safe and reliable and does not require any complicated controlling devices. In addition, the apparatus for carrying out the opening and unfolding operation is uncomplicated and does not have any components susceptible to failure or breakdown.

These and other objects of the invention will become readily apparent from the following detailed description considered in connection with the accompanying drawings which disclose several embodiments of the invention. It is to be understood that the drawings are to be used for the purposes of illustration only, and not as a definition of the limits of the invention.

BRIEF DESCRIPTION OF THE DRAWINGS

In the drawings wherein similar reference characters denote similar elements throughout the several views.

DESCRIPTION OF THE PREFERRED EMBODIMENTS

Figure 1:
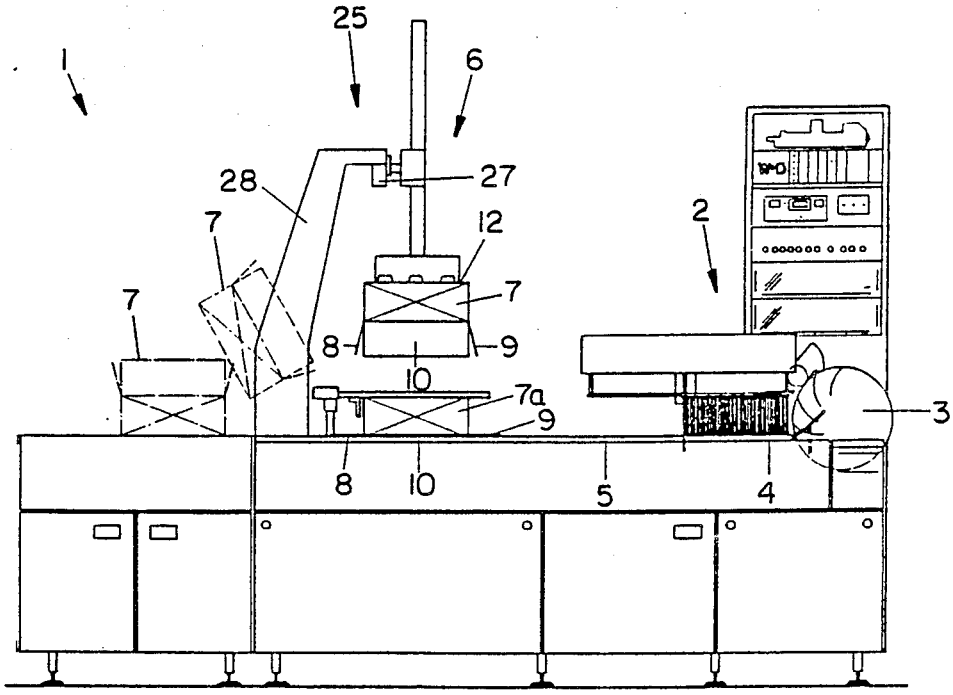
FIG. 1 is a side elevational view of a letter envelope packaging machine with an integrated apparatus for opening the flaps of a cardboard or folding box, already sealed on its bottom side.
Figure 2:
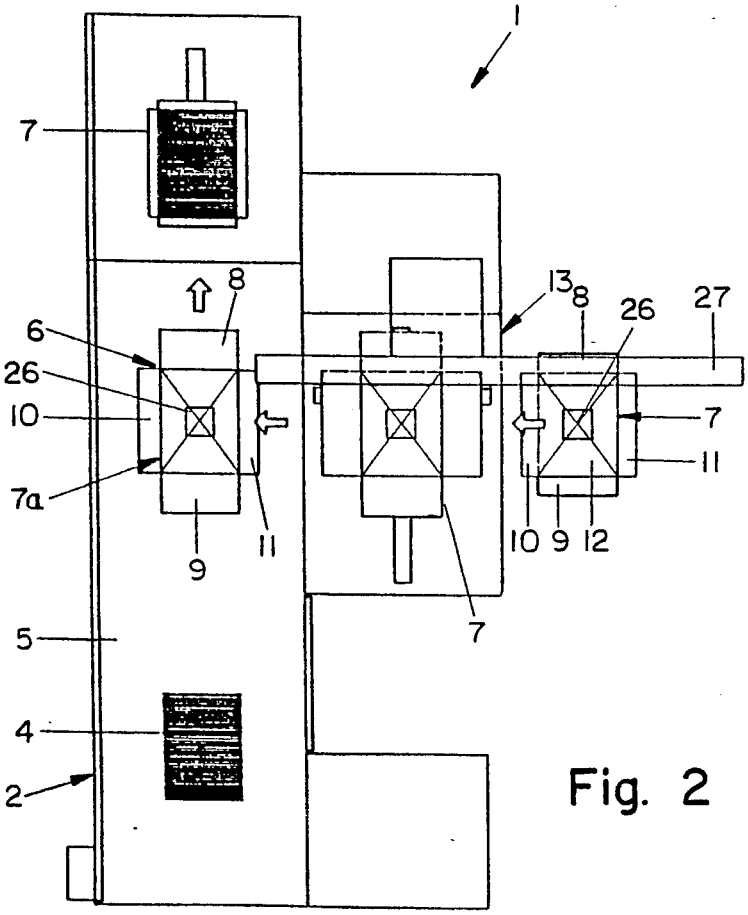
FIG. 2 is a top view of the apparatus for opening the flaps of a carton as shown in FIG. 1.

Referring to FIGS. 1 and 2, there is shown an example of a letter envelope packaging machine 1 containing a stacking station 2 with a fan disk 3 for positioning each individually arriving letter envelope. The letter envelope stacks 4 are formed in stacking station 2 and subsequently pushed on a work table 5 (not described herein in detail) into a packaging station 6. At packaging station 6, inverted cardboard boxes or cartons 7, with sealed bottom sides, and with open tops flaps 8, 9, or 10, 11, which flaps hang down and are left here sufficiently opened, i.e., their free edges are slightly pointing away from each other, are pushed over letter envelope stack 4 as shown by box 7*a* in FIG. 1. Thereafter, the full boxes 7, 7*a* are then lifted, turned and sealed in a manner known in the art (and not shown here in detail) on the left side of packaging station 6 in FIG. 1 as shown by the dashed lines.

Figure 3:
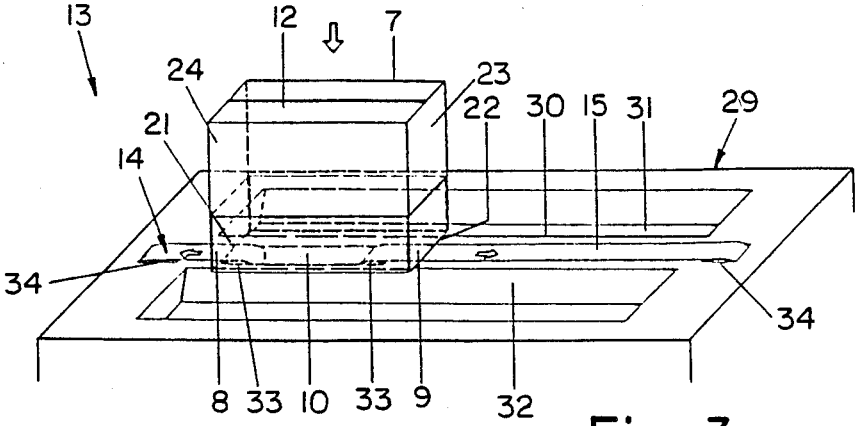
FIG. 3 is a schematic perspective view of a first embodiment of the integrated apparatus for opening the flaps of the carton before the flaps are opened.
Figure 4:
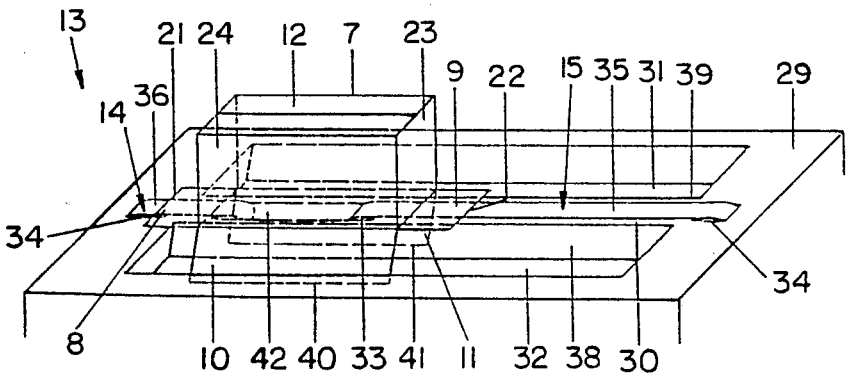
FIG. 4 is a schematic perspective view of the apparatus of FIG. 3 after the sealing flaps have been opened.

As seen in FIGS. 2 and 4, a sealing flap opening station 13 is provided to insure that top flaps 8, 9 and/or 10, 11 of boxes 7, having a sealed bottom 12, are adequately opened (or directed away from each other) into the desired or required position when box 7 is in packaging station 6. In sealing flap opening station 13, box 7, disposed in an inverted position with the bottom 12 up and the sealing flaps 8 to 11 hanging down, is lowered from a floating position, and placed on the drive elements 14, 15, or 14 to 16, or 18, 19 and 20, which are shown in detail in FIGS. 3 to 10. These drive elements 14 to 20 seize the free edges, e.g. the edges 21, 22 of flaps 8, 9 of box 7, and fold them from the partially open position shown in FIG. 3 into the open position shown in FIG. 4. During this operation drive elements 14 and 15 move away from each other and open, spread or fold flaps 8, 9 in the opening direction. Box 7 is continuously lowered during this operation so that not only flaps 8, 9 rest on drive elements 14, 15 but additionally sidewalls 23, 24 supporting the sealing flaps 8 and 9 rest thereon. After the condition shown in FIG. 4 has been reached, sealing flaps 8 and 9 are set at right angles relative to the sidewalls 23 and 24 in position sufficiently opened to then be lifted and transported from sealing flap opening station 13 to packaging station 6. The boxes in this condition can be pushed without problem over a letter envelope stack 4 present in that station.

Referring again in FIGS. 1 and 2, box 7, may, for example, be transported to sealing flap opening station 13 and from there to packaging station 6, by means of a robot-like transporting device 25. Robot device 25, with the help of one or several suction elements 26, carries boxes 7 by their bottom sides and, for example, along a rail 27 between the various stations, both in the horizontal and vertical directions along one or several columns 28, on which the robot-device is displaceable.

As seen best in FIGS. 3 and 4, sealing flap opening station 13 comprises a work plate or table 29 with two parallel extending recesses as channels 31 and 32, the latter being connected by a center bridge 30. Drive elements 14 and 15, which, when operating, move away from each other, are mounted on center bridge 30. In the embodiment shown, drive elements 14 and 15 are endless rotating belts, as shown in greater detail in FIG. 7. The rotation of the endless belts are provided by the reversing rolls 33 and the driving rolls 34 which are provided for each belt-shaped drive element 14, 15. The drive elements are supported in table 29, with their upper runs 35, 36, which runs move as indicated by the arrows in FIGS. 3 and 7, raised slightly above the plane of surface 37 of table 29.

Figure 7:
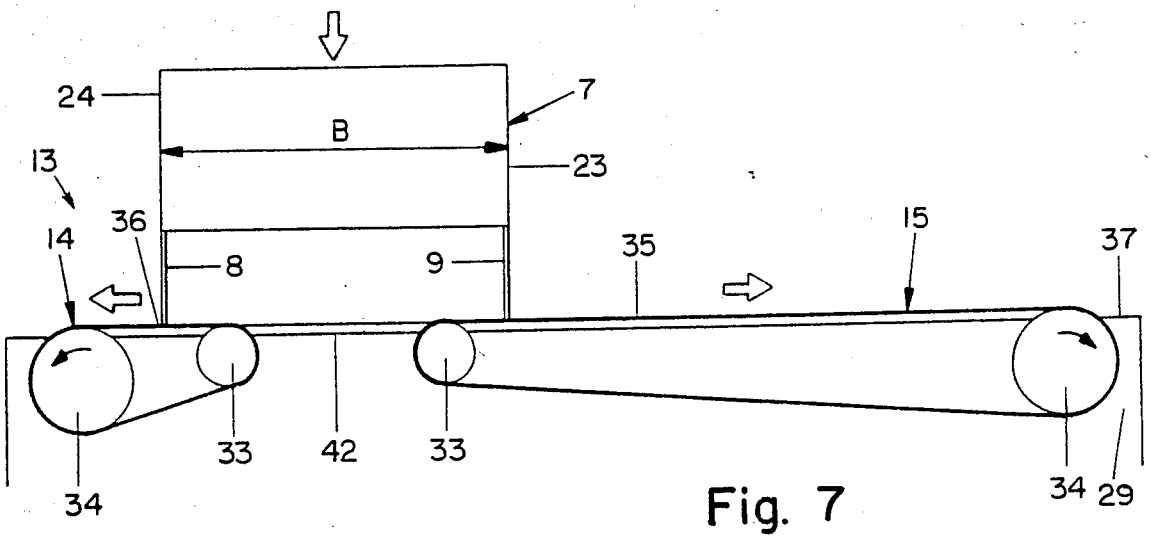
FIG. 7 is an enlarged schematic side view of the embodiments shown in FIGS. 3 to 6.
Figure 8:
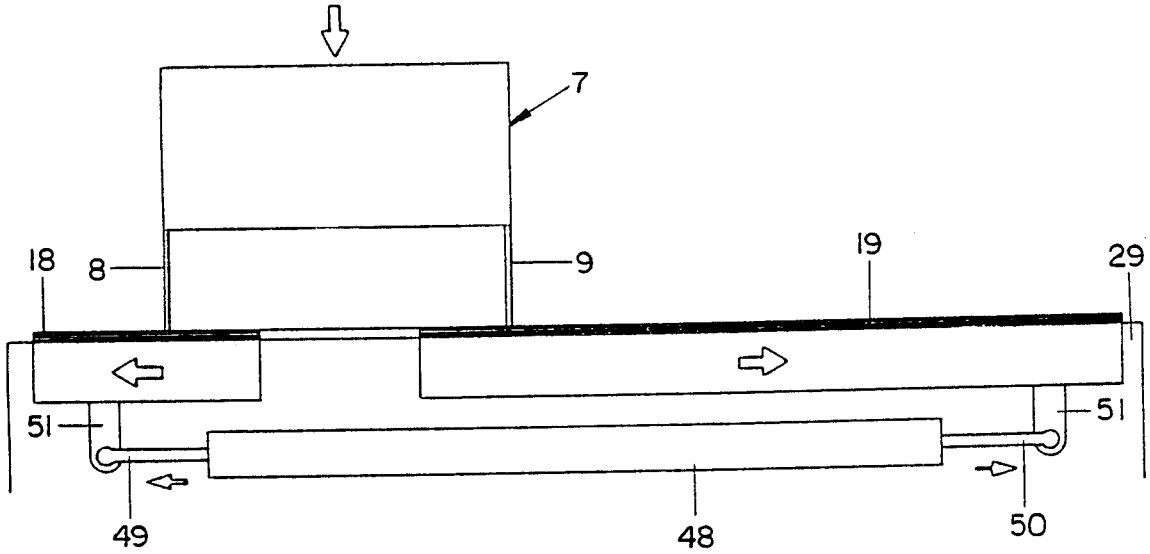
FIG. 8 is a schematic side view of a third embodiment of the apparatus.

As seen best in FIG. 7, reversing rolls 33 and driving rolls 34 are arranged below the surface of table 29, whereby the position of adjacent rolls 33 has been selected in such a way that such rolls are disposed within the width B, of each box 7, or interiorly of the sidewalls 23, 24 of the box, and hence within the width of sealing flaps 8, 9 of the box. In addition, the two belt-shaped drive elements 14 and 15, as shown in FIGS. 3, 4 and 7, are aligned in one plane.

Preferably, the two endless belts 14 and 15 have different lengths; with endless belt 14, for example, being relatively short, whereas endless belt 15 may have any desired length. In this way a wide variety of different size boxes can be processed in the same sealing flap opening station 13 with sealing flap 8 being swung in the opening direction by the relatively short endless belt 14, and with the other sealing flap 9 comes to rest at any point within the length of endless belt 15 whereby it is then also opened.

Referring again to FIGS. 3 and 4, channels 31 and 32 serve as aids for opening the sealing flaps, specifically long lateral flaps 10 and 11. In order to spread these flaps open, center bridge 30 has lateral surfaces 38 and 39 which diverge or flare laterally outward and downward, as shown by the arrow in FIG. 3, i.e., in the direction in which the box is deposited. Thus, lateral sealing flaps 10, 11 can be adequately opened in many applications if their free edges 40, 41 slide along lateral surfaces 38 and 39 of center bridge 30 as boxes 7 are lowered. The result of this opening or spreading operation is shown in FIG. 4. The endless revolving belts drive 14 and 15 are, by way of example, rubber or rubber-like belts with a high coefficient of friction. Their upper runs, 35 and 36, preferably rest on center bridge 30, which has a recess 42 only in the area of box 7 or of the two reversing rolls 33.

Figure 5:
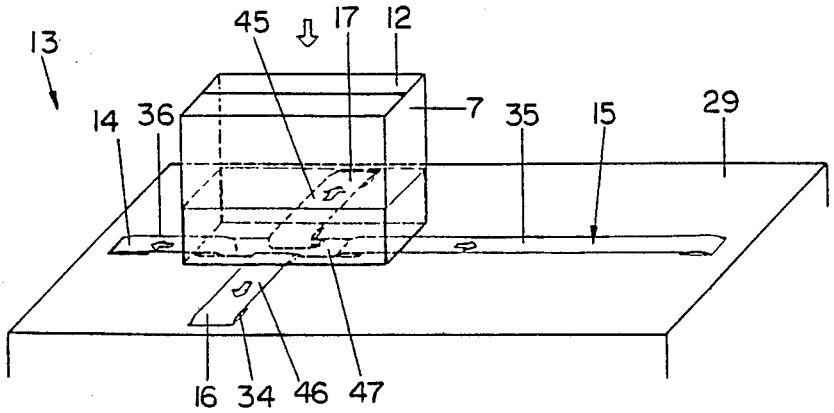
FIG. 5 is a schematic perspective view of a second embodiment of the integrated apparatus for opening the flaps of the carton before the flaps are opened.
Figure 6:
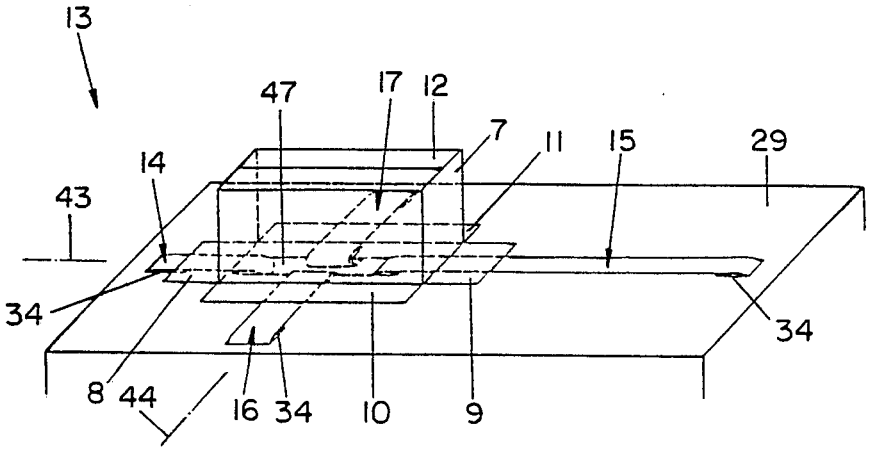
FIG. 6 is a schematic perspective view of the embodiment of FIG. 5 after the flaps have been opened.

FIGS. 5 and 6 illustrate a modified embodiment. Sealing flap opening station 13 comprises a table or depositing plate 29, as well as four separate drive elements 14, 15, and 16, 17, which move along crossing or intersecting axes 43, 44 and away from each other. Again, endless rotating belts serve as the drive elements. The upper runs 35, 36, and 45, 46 of these drive elements move away from box 7 as shown by the arrows in FIG. 5. The belts 14 to 17 are guided on the reversing rolls 33 and the driving rolls 34 according to FIG. 7. Again rolls 33 and 34 are arranged below the table or depositing plate 29 in such a way that each upper run 35, 36, or 45, 46 is positioned directly on or above the surface of depositing plate or table 29.

Within the area adjacent box 7, table or depositing plate 29 has a recess or slot 47 through which the belt-like driving elements 14 to 17 pass from the bottom to the top around their reversing rolls 33 (as shown in FIG. 7). These drive elements move away from each other at right angles along intersecting axes 43, 44, as shown by the arrows in FIG. 5. Belt-like drive elements 16 and 17, may be relatively short, like element 14, as compared with the fourth belt-like driving element 15. Consequently, in flap opening station 13 shown in FIGS. 5 and 6, sealing flaps 8, 9, and 10 and 11 of differently sized boxes 7 can be folded open or brought into a safe open position according to FIG. 6.

The drive elements do not necessarily have to be endless rotating belts. Instead they can be sliding members or slides 18, 19 schematically shown in FIG. 8. Slides 18 and 19 are suitably supported and guided within table or depositing plate 29, permitting them to move away from each other as indicated by the arrows. Drive 48 may be a piston-and-cylinder arrangement wherein piston rods 49 and 50 engage the drive elements 51 of the sliding members 18 and 19, moving the latter away from each other along a straight line as indicated by the arrows. Therefore, sliding members 18, 19 will unfold flaps 8 and 9 resting thereon, i.e., flaps 8 and 9 of the box 7 are folded open away from each other in the opening direction. The sliding slides 18 and 19 and the belt-like drive elements 14 to 17 shown in FIGS. 5 and 6 may be integrated into working or table top plate 29 in a manner to intersect each other on such a plate. This way all four sealing flaps 8 to 11 are opened.

Figure 9:
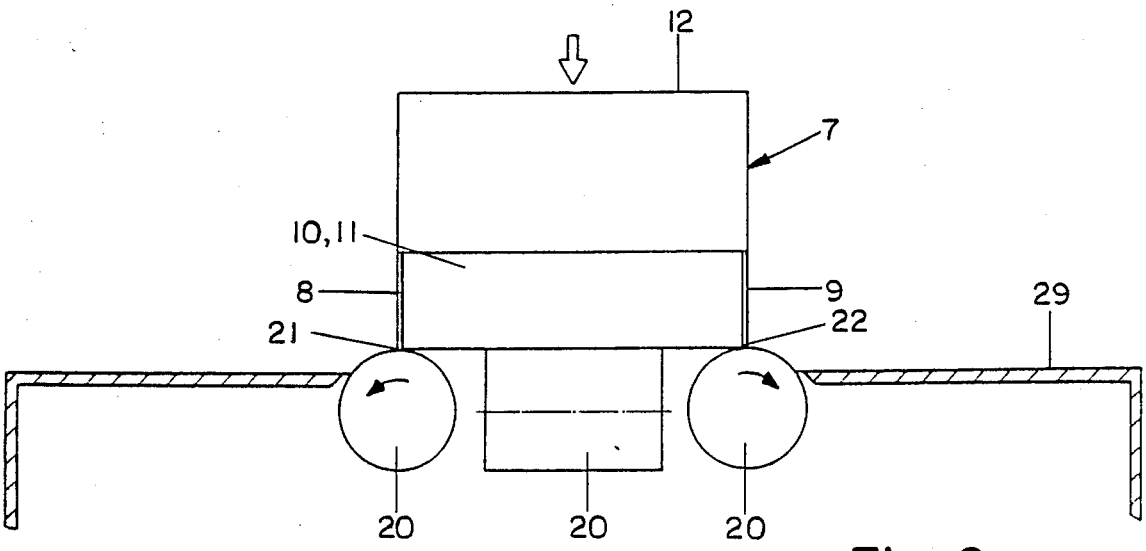
FIG. 9 is a schematic side view of a fourth embodiment of the integral apparatus for opening the flaps prior to their being opened.
Figure 10:
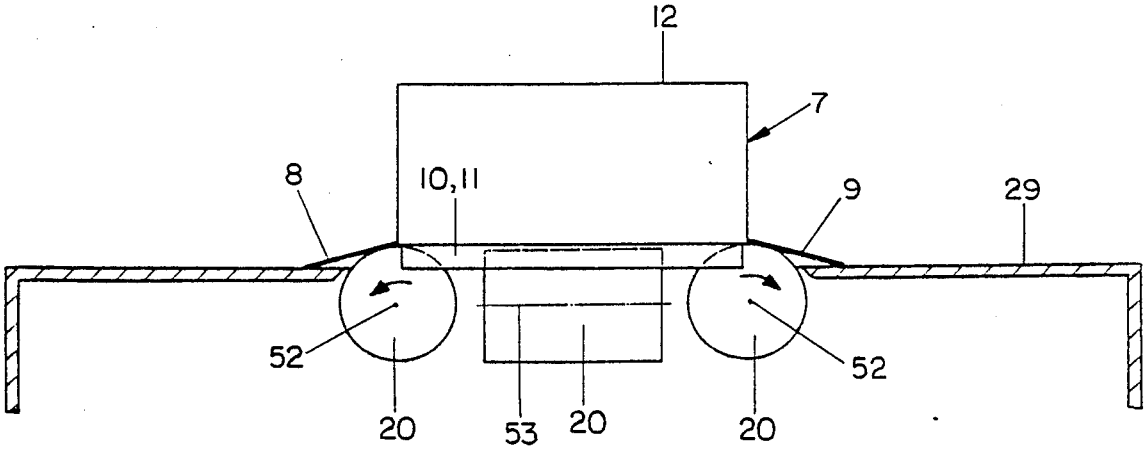
FIG. 10 is a schematic side view of the apparatus of FIG. 9 after the flaps have been opened.

Referring to FIGS. 9 and 10, a further embodiment is schematically shown which is provided with a driven roll 20 as the drive element for each of the sealing flaps 8, 9, or 10, 11. Axles 52, 53 of these rolls are disposed beneath the table or working plate 29 and arranged in pairs parallel with each other and/or vertically aligned relative to one another. The driving and moving direction of the rolls serving as drive elements 20 is always directed away from one another as shown by the arrows in FIGS. 8 and 9. Hence the sealing flaps 8 to 11 of a box 7 are spread apart in the opening direction as box 7 is lowered from a floating position in the direction indicated by the arrow in FIG. 9. Upon lowering box 7 sealing flaps 8 to 11 are each placed on one roll 20 revolving in the opening or spreading apart direction.

It is, therefore, necessary, and this applies to all of the embodiments described above, that as box 7 is lowered, sealing flaps 8 to 11 have only their free edges loosely placed on a plane or curved drive element, and that such driving elements moves in the desired opening direction. The drive element swings the associated sealing flap into the desired opening direction corresponding with its direction of motion only by adhesion and frictional contact, with the box being simultaneously lowered until the sealing flaps have reached their final open position. At this point they may be positioned vertically relative to sidewalls 23, 24 of box 7 as shown in FIGS. 3 to 6.

While only several examples and embodiments of the present invention have been shown and described, it is obvious that many changes and modifications may be made thereunto, without departing from the spirit and scope of the invention.

What is claimed is:

1. A process for spreading open at least one folding top closure flap of a carton of the type having a closed sealed bottom comprising the steps of:

supporting the carton box bottom side up with the closure flap hanging down;

lowering the folding box onto at least one drive element so that edge of the closure flap engages said drive element; and moving the drive element in a direction away from the interior of the carton so that the closure flap is spread by frictional contact with said drive element to an open position.

2. An apparatus for spreading open at least one folding top carton flap of the type having a closed sealed bottom comprising:

a work surface;

means for supporting the carton above said work surface by the bottom thereof with said at least one closure flap hanging down;

means for spreading at least one flap to an open position including a drive element, said drive element moveable in a direction away from the interior of the carton so as to spread the closure flap by frictional contact with said drive element to said open position; and means for lowering the carton onto said means for spreading.

3. The apparatus is defined in claim 2 wherein said drive element is an endless revolving belt.

4. The apparatus as defined in claim 2, wherein said drive element is a sliding piece.

5. The apparatus as defined in claim 2, wherein said drive element is a roll.

6. The apparatus as defined in claim 2, wherein in at least two drive elements, each movable away from the interior of the carton are provided.

7. The apparatus as defined in claim 2, wherein four drive elements are provided, each moveable away from the interior of the carton.

8. The apparatus as defined in claim 6, wherein said drive elements are arranged relative to each other in the form of a cross.

9. The apparatus as defined in claim 2, additionally including a table on which said work surface is defined and said drive element is mounted on said table and is integrated into said surface.

10. The apparatus as defined in claim 2, additionally including a depository plate on which said work surface is defined and said drive element is mounted on said depository plate and is integrated into said surface.

11. The apparatus as defined in claim 2, wherein said means for lowering the carton includes a robot-like transporting device.

* * * * *